US005185105A

United States Patent [19]

Peterson

[11] Patent Number: 5,185,105

[45] Date of Patent: Feb. 9, 1993

[54] SPLASH BAR CONSTRUCTION FOR A COOLING TOWER

[76] Inventor: Charles A. Peterson, 2201 Lord Ashley Dr., Sanford, N.C. 27330

[21] Appl. No.: 861,582

[22] Filed: Apr. 1, 1992

[51] Int. Cl.[5] ..... B01F 5/00

[52] U.S. Cl. ..... 261/111

[58] Field of Search ..... 261/111, 94

[56] References Cited

U.S. PATENT DOCUMENTS

| | | | |
|---|---|---|---|
| 2,634,959 | 4/1953 | Cave | 261/111 |
| 2,780,306 | 2/1957 | Boyle et al. | 261/111 |
| 3,010,706 | 11/1961 | McWilliams | 261/100 |
| 3,389,895 | 6/1968 | DeFlon | 261/111 |
| 3,410,057 | 11/1968 | Lerner | 261/94 |
| 3,430,934 | 3/1969 | Weishaupt | 261/94 |
| 4,133,851 | 1/1979 | Ovard | 261/111 |
| 4,481,154 | 11/1984 | Gough et al. | 261/94 |
| 4,562,015 | 12/1985 | Lefevre | 261/94 |
| 4,575,435 | 3/1986 | Kühl | 261/94 |
| 4,705,653 | 11/1987 | Stackhouse et al. | 261/111 |
| 4,803,018 | 2/1989 | Lefevre et al. | 261/111 |
| 4,915,877 | 4/1990 | Shepherd | 261/111 |
| 4,985,182 | 1/1991 | Basse et al. | 261/94 |

FOREIGN PATENT DOCUMENTS

| | | | |
|---|---|---|---|
| 1363416 | 8/1974 | United Kingdom | 261/DIG. 11 |

*Primary Examiner*—Tim Miles

*Attorney, Agent, or Firm*—Harry Williams

[57] ABSTRACT

A splash bar for use in cooling towers in which a plastic strand material having an irregular surface is formed to provide a tubular network of similarly-shaped interstices that effect a maximum splash-effect and prevent water-film build up on the splash bar. The individual strand portions forming the interstices of the tubular splash bar cooperate with support rods in a cooling tower for securing the splash bar into a fixed horizontal position without the aid of auxiliary clamping members or additional structure other than the splash bar itself.

10 Claims, 3 Drawing Sheets

SPLASH BAR CONSTRUCTION FOR A COOLING TOWER

BACKGROUND OF THE INVENTION

This invention relates to the use of splash bars in cooling towers and other direct-contact heat and mass transfer structures and particularly to an improved splash bar construction.

In general cooling towers include a large housing through which air is admitted and exhausted while at the same time water to be cooled is distributed throughout the housing by means of gravity and is cooled during its descent by its intimate contact with the air moving through the housing. During its descent the water is broken up into smaller droplets by contact with splash bars which break up the downward flow of the water and provide an increased surface area for commingling the water and air passing through the housing to promote cooling. As is well known, such cooling towers may be of the cross-flow type in which the air travels transversely to the descent of the water, or of the counter-flow type in which the air travels in a direction opposite to the descent of the water. The splash bars are horizontally stacked so that spaced-apart bars in each row are separate and staggered from bars in adjacent rows. To secure this arrangement, vertical and horizontal rod supports are provided upon which and against which the bars are secured by suitable clamps or other devices.

In particular, splash bars used in such cooling towers should be of such a configuration that optimum cooling is achieved by maximum liquid disbursement so that maximum splash is created from one bar to another, that is, the creation of the smallest droplets for maximizing a heat and mass transfer surface for the air passing through the tower.

This optimum condition—of the creation of small droplets—is often defeated by the use of splash bars which cannot maintain their horizontality in the cooling tower and thus create water-slide or a cascading effect along the accumulated slant of the bars, that is, an uninterrupted surface, especially a flat surface, along which the cascading effect of the water can form to thereby become an abosorbent film. In such cases, too, vibration of the bars can occur, owing to the cascading and accumulating effects of the water, such that the structural integrity of the bars is then weakened over time, often resulting in breakage.

In attempting to maintain strict horizontality of conventional splash bars, recourse is often had to the use of elaborate securing devices for fixing the bars to horizontal and vertical rod supports within the cooling tower. Such securing devices—often in the form of additional securing members, such as clamps, or adjunct structure associated with each bar assembly—require added time and expense to manufacture as well as additional time to install in the cooling tower.

In still other cases, splash bars are constructed from flat perforated sheet material for enhancing liquid break-up when the water moves from one surface to the next. In such cases the perforations in the sheet members—because of constant inundation from the water—are given to forming cracks along the edges of the holes which will eventually weaken the bars and cause breakage. In fact, splash bars of any given flat-surface design, regardless of the perforation or the hole design, will of necessity offer some form of a flat surface to the descending water and thereby augment not the formation of a splash effect, that is, the creation of droplets, but of the formation of a water film which will effectively absorb any surrounding splash. If larger holes are used in the sheet-type of splash bars then, of course, structural strength and integrity are sacrificed.

OBJECTS AND SUMMARY OF THE INVENTION

It is a primary purpose and principle object of the present to overcome the aforementioned disadvantages and provide, therefore, a splash bar construction for a cooling tower which will maximize the splash effect of the descending water in such towers, that is, create smaller droplets than heretofore known and hence a larger surface for heat and mass transfer.

A main feature of the present invention is to prevent the formation of water-film, water-slide and water-cascade during the water's descent in a cooling tower while at the same time create a maximum splash effect and thus a continuing creation of water droplets It is another feature of the present invention to maintain horizontality of the splash bar construction within a cooling tower in a simple and efficient manner.

It is yet another feature of the present invention to provide a splash bar construction in which no one part of the splash bar offers a water-film creating surface.

It is still another feature of the present invention to prevent vibration of the splash bars while undergoing continued water inundation in a cooling tower.

It is yet another feature of the present invention to provide a splash bar construction having no moving parts in which no additional, auxiliary or adjunct structures are required for securing the splash bars to the supporting rods in a cooling tower.

It is still a further feature of the present invention to provide a splash bar construction having excellent strength and structural integrity, which at the same time is light in weight and simple to manufacture and which can be easily handled and installed in a cooling tower, requiring only minimum attention.

It is yet another feature of the present invention to provide a splash bar construction having no moving parts and which can be easily cut to different lengths at any juncture thereof without compromising its structural and functional integrity.

According to one embodiment of the present invention there is provided a splash bar in which a plastic strand material having an irregular surface is formed to provide a tubular network of similarly shaped interstices. Further, the interstices of the tubular splash bar, according to the invention, cooperate with the conventional support rods in a cooling tower for securing the splash bar into a fixed horizontal position without the aid of auxiliary clamping members or any additional or adjunct structure that might otherwise be required for that purpose.

In a further embodiment of the present invention a splash bar is provided in which a strand of plastic material forms a network of similarly shaped interstices and in which the plastic strand material is made up of two differently-diametered strands so that each interstice is bounded by both the differently-diametered strand material.

The invention will be better understood as well as furthere objects and advantages thereof become more apparent from the ensuing detailed description taken in conjunction with the drawings.

DETAILED DESCRIPTION

Figure 1:
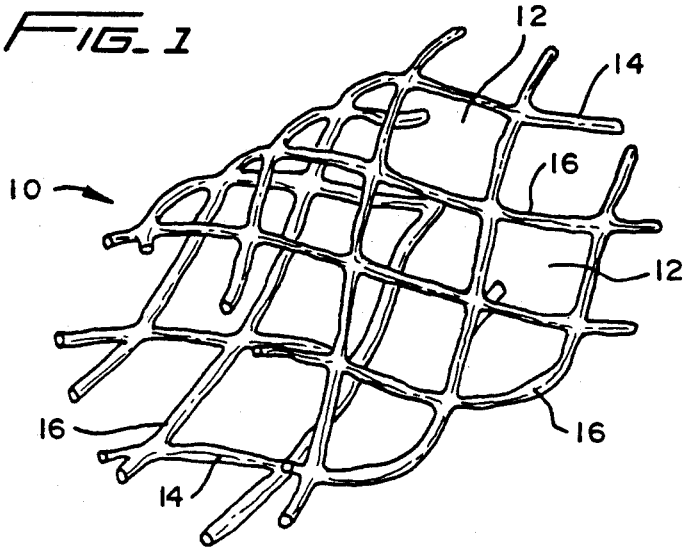
FIG. 1 is a schematic perspective view of a portion of the splash bar according to the invention.

Referring now to FIG. 1, there is shown a portion of a hollow tubular splash bar 10 which will normally have an extension of several feet for being disposed within a conventional cooling tower (not shown). It is to be understood that many such splash bars can be installed in a cooling tower, such that they can be stacked in a conventional manner in spaced-apart rows (not shown). so that water descending in the cooling tower will contact the splash bars and thereby break-up or splash into droplets. The air passing through the cooling tower. whether in a counter-flow direction or a cross-current direction, will then contact the water droplets and becomes cooled owing to the increased heat transfer surface afforded by the droplets. It is important, then, that such splash bars continually break up the descending water into droplets and that they not allow the water to accumulate into a film of any kind along the surface of the splash bar, which can result in a water-cascading effect which will defeat the creation of water droplets Accordingly, the splash bar 10, according to the invention, is seen to comprise a network of interstices 12 which are made up by a strand material 14. This strand material can be a plastic, such as a polypropelene or like material formed by an extrusion process which is not a part of this invention. When so formed, the strand material 14 usually shrinks when cooled so that the surface area of the strand material forms an uneven surface 16, owing to the shrinkage. It should be understood, however, that in some extrusion processes where heat is not a factor, or where a more heat-resistant plastic material is used, the strand material 14 will not shrink and therefore will form a uniformly tubular surface. An uneven surface is preferable, however, because it has been found to maximize the splash effect and prevent the formation of water film on the surface of the strand material. It had been found, too, that the interstices cannot be too large or too small, for in the former case the water would pass through without break-up, and in the latter too much surface area would present itself to the descending water so that water-film would then form on the splash bar surface. Preferably, too, the cross-sectional shape of the splash bar 10 is elliptical, a shape which offers a greater area of surface contact with the descending water than would a circular splash bar, although a circular splash bar will suffice. The elliptical-shaped cross section of the splash bar 10 also enhances the locking function of the splash bar with respect to the vertical support rods in the cooling tower, as will be explained below.

Figure 2:
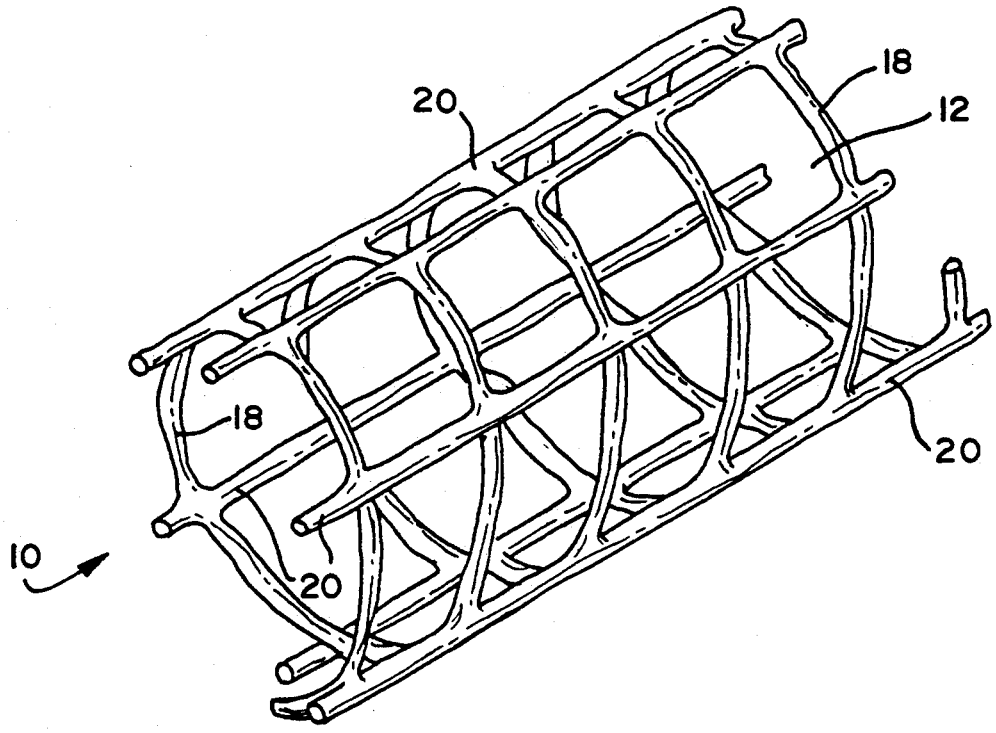
FIG. 2 is a schematic perspective of a portion of another embodiment of the splash bar according to the invention.

In FIG. 2 another embodiment of the splash bar 10 is shown in which the interstices 12 are formed by a spiral 18 of strand material which is joined or supported by longitudinally extending rod-like members 20.

Figure 3:
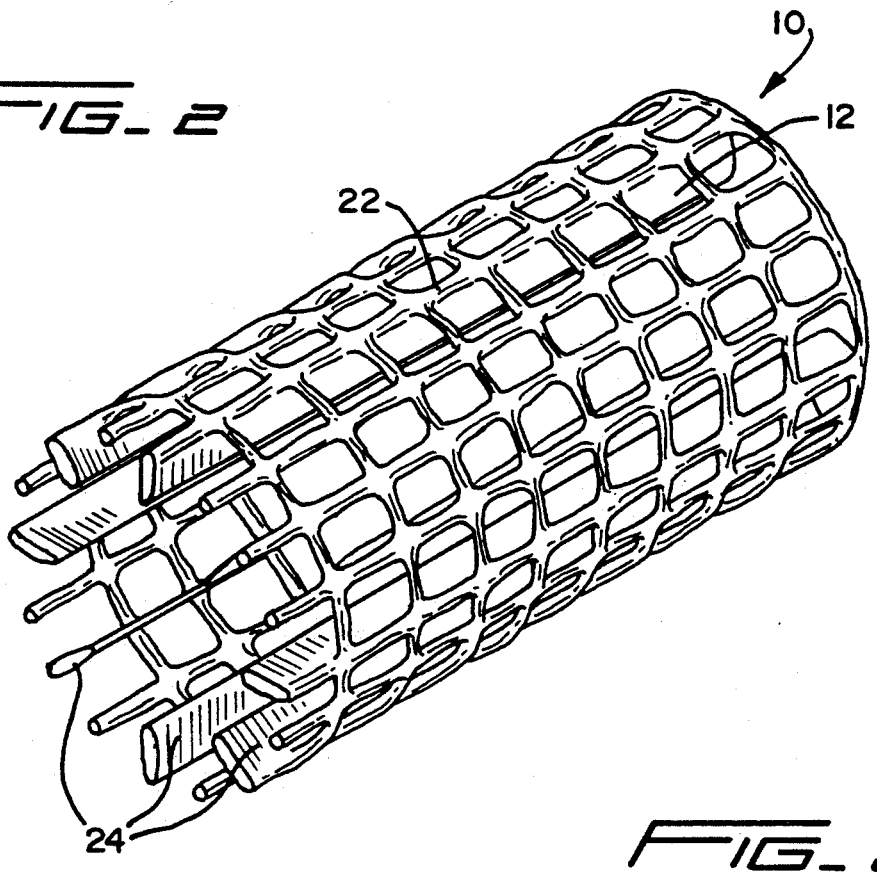
FIG. 3 is a schematic perspective of a portion of a further embodiment of the splash bar according to the invention.

In FIG. 3 a further embodiment is shown in which the hollow tubular splash bar 10 in which the interstices 12 are formed by a rectangular pattern 22 of the plastic strand material. Also shown in this embodiment are fin members 24 extending radially inwardly towards but not touching the central axis of the splash bar. It had been found that not all the strand members 22 need be modified by these radial fin members 24, but that only selected ones of said strand members 22 need be so provided in order to enhance break-up of the water passing through such a splash bar. Further, the fin members need only extend a small distance inwardly from the peripheral region of the splash bar in order to maximize splash effect.

Figure 4:
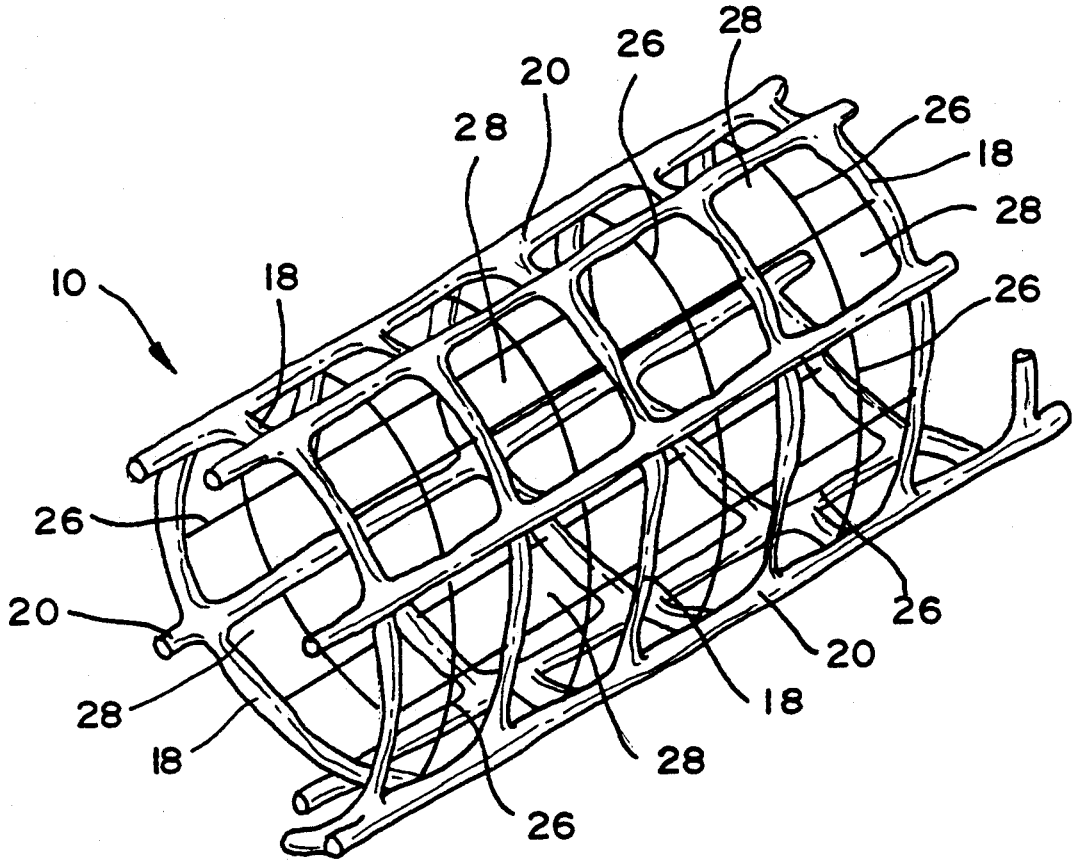
FIG. 4 is a schematic perspective of a portion of a still further embodiment of the splash bar according to the invention.

FIG. 4 shows another embodiment of the splash bar 10 similar to that shown in FIG. 2 (like numerals are shown for like parts) except that a further strand material 26 is provided, which material is seen to be significantly smaller in diameter than the strand material 18 and 20. These smaller strands 26 are seen to divide the interstices into smaller sections 28 than those shown in FIG. 2, so that each interstice 28 is bounded by both the smaller and the larger diametered strand material, 18, 20 and 26 respectively. It has been found that these smaller-diametered strands 26 when so constructed as shown in FIG. 4 also enhance structural strength and water break-up, that is, droplet formation, as described above.

Figure 5:
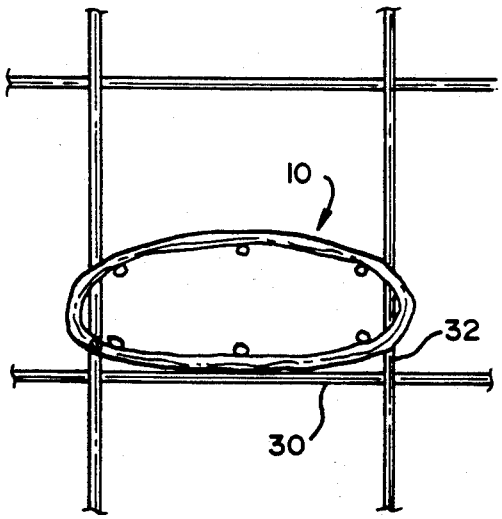
FIG. 5 is a schematic end view of the embodiment shown in FIG. 1 in which the splash bar is shown fixed by the support bars.
Figure 6:
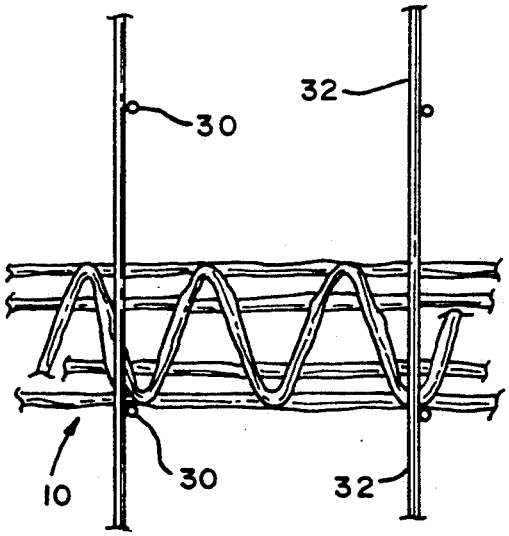
FIG. 6 is a schematic side elevational view of the splash bar and support bars shown in FIG. 5.

In FIGS. 5 and 6 are shown the support bars normally used in a cooling tower. Horizontally arranged support rods 30 and vertically arranged rods 32 form a grid-like pattern in the conventional manner so that splash bar assemblies can be inserted in selected grids and then subsequently fixed into place. It is important to fix the splash bars in place in order to prevent vibration of the splash bars from occurring because of a loose support. In such cases vibration caused by the continuing descent of water on the splash bar assemblies will eventually weaken them and ultimately cause breakage. As shown by the present invention, however, the splash bar 1O is seen to be inserted in one of the grids so formed by the rods 30 and 32 It will be seen that by virtue of the unique design of the splash bar 10 no support structure or additional clamps are required for fixing the splash bar in place, because the vertical rods 32 extend through those interstices 12 nearest them and hence press against the nearest strand material 14, which allows a part of the strand material to extend beyond the plane of the rod members so that the splash bar 10 is virtually locked into place and thereby prevented from moving either longitudinally or laterally. Since the water in the cooling towers is always moving downwardly and thereby pressing the splash bars continually against their horizontal support rods 30, the space shown above the splash bar 10 is of no importance other than to allow the splash bar to be turned or freed and so manipulated into and out of place. It will also be seen that the the elliptical cross-section of the splash bar 10 improves it locking function with respect to the vertical rod members 32, since the strand material is seen to extend a greater distance beyond the respective planes of the rod members 32 than would otherwise occur with a strictly circular splash bar, although the circular splash bar, if flexible, would function in the same way, if only slightly less effectively.

The foregoing relates to preferred exemplary embodiments of the invention, it being understood that other embodiments and variants thereof are possible within the scope of the invention, the latter being defined by the appended claims.

What is claimed and desired to be secured by Letters Patent of the United States is:

1. A cooling tower having water descending therethrough and having an array of spaced-apart support bars horizontally supporting and fixing splash bars, said splash bars comprising a strand material having an irregular surface and forming a network of similarly-shaped interstices, said network of interstices defining the peripheral region of said splash bars, whereby said splash bars create a maximum splash effect and concomitantly prevents the formation of a water film thereon.

2. Apparatus according to claim 1, wherein some of said support bars traverse the space defining random ones of said interstices and thereby press against portions of said strand material.

3. Apparatus according to claim 1, wherein said interstices are each generally diamond shaped.

4. Apparatus according to claim 1, wherein said interstices are each generally rectangular shaped.

5. Apparatus according to claim 1, wherein said network comprises a spiral of said strand material and a plural number of rod-like members of said strand material joined with and extending longitudinally of said spiral.

6. Apparatus according to claim 1, wherein said strand material comprises differently-diametered sections bordering said interstices.

7. Apparatus according to claim 1, wherein said splash bars are elliptical in cross-section.

8. Apparatus according to claim 1, further comprising a plural number of fin members radially extending inwardly from the peripheral region of said splash bars towards a central longitudinal axis of said splash bars but not touching said axis.

9. A cooling tower having water descending therethrough and having a first array of spaced-apart support bars horizontally supporting splash bars and a second array of spaced-apart support bars generally normal to said first array for laterally and longitudinally fixing said splash bars said splash bars comprising a tubular strand material of plastic forming a network of similarly-shaped interstices, said network of interstices defining the peripheral region of said hollow tubular splash bars, and said second array of support bars traversing the space defining random ones of said interstices to thereby press against portions of said strand material.

10. A cooling tower having water descending therethrough, means in said tower for horizontally supporting a plurality of splash bars in spaced-apart relationship, said bars comprising a strand material having an irregular surface and forming a network of similarly-shaped interstices, said network of interstices defining the peripheral region of said hollow tubular splash bars and said splash bars having an elliptical-shaped cross-section, whereby said splash bars are caused to create a maximum splash effect and concomitantly prevent the formation of a water film thereon.

* * * * *